US011208859B2

(12) United States Patent
LaValley et al.

(10) Patent No.: US 11,208,859 B2
(45) Date of Patent: Dec. 28, 2021

(54) PIT PUMP FOR USE IN A DRILLING FLUID RECYCLING SYSTEM

(71) Applicant: LaValley Industries, LLC, Bemidji, MN (US)

(72) Inventors: Jason LaValley, Bemidji, MN (US); Douglas Coutlee, Bemidji, MN (US); Daniel Larson, Bemidji, MN (US)

(73) Assignee: LAVALLEY INDUSTRIES, LLC, Bemidji, MN (US)

( * ) Notice: Subject to any disclaimer, the term of this patent is extended or adjusted under 35 U.S.C. 154(b) by 0 days.

(21) Appl. No.: 16/818,565

(22) Filed: Mar. 13, 2020

(65) Prior Publication Data

US 2020/0318445 A1 Oct. 8, 2020

Related U.S. Application Data

(60) Provisional application No. 62/819,109, filed on Mar. 15, 2019.

(51) Int. Cl.

| | |
|---|---|
| ***E21B 21/01*** | (2006.01) |
| ***E21B 21/06*** | (2006.01) |
| ***E21B 21/08*** | (2006.01) |
| *E21B 21/00* | (2006.01) |

(52) U.S. Cl.

CPC ..... *E21B 21/01* (2013.01); *E21B 21/06* (2013.01); *E21B 21/08* (2013.01); *E21B 21/003* (2013.01)

(58) Field of Classification Search

CPC ..... E21B 21/01; E21B 21/08; E21B 21/06

See application file for complete search history.

(56) References Cited

U.S. PATENT DOCUMENTS 3,060,335 A * 10/1962 Greenwald ..... H02K 9/19 310/54
3,961,758 A 6/1976 Morgan
4,331,458 A * 5/1982 Liljestrand ..... E21B 21/067 55/406

(Continued)

FOREIGN PATENT DOCUMENTS

EP 1229251 A1 8/2002
WO 2014116249 A1 7/2014

OTHER PUBLICATIONS

International Search Report and Written Opinion issue in PCT/US2020/022699, dated Jul. 2, 2020.

*Primary Examiner* — D. Andrews
(74) *Attorney, Agent, or Firm* — Hamre, Schumann, Mueller & Larson, P.C.

(57) ABSTRACT

A pit pump of a drilling fluid recycling system where the pit pump is driven by a liquid cooled electric drive motor that is cooled by a cooling liquid. The pit pump can stay submerged in the used drilling fluid within the pit indefinitely since the pit pump does not require cleaning to remove caked on drilling fluid to prevent overheating of the electric drive motor since the cooling liquid cools the electric drive motor. This reduces or eliminates the need to remove the pit pump from the pit for servicing. The electric drive motor can also be reversible to reverse the rotation direction of the pit pump. Further, the pit pump can include its own controller, located within the pit or outside the pit, connected to various sensors that can be used for health monitoring of the pit pump and controlling operation of the pit pump.

25 Claims, 4 Drawing Sheets

(56) References Cited

U.S. PATENT DOCUMENTS

| | | | | |
|---|---|---|---|---|
| 5,202,194 | A * | 4/1993 | VanBerg, Jr. | H01M 8/00 429/437 |
| 5,529,462 | A | 6/1996 | Hawes | |
| 5,616,973 | A * | 4/1997 | Khazanov | H02K 5/20 310/54 |
| 2008/0267785 | A1 | 10/2008 | Cervenka et al. | |
| 2015/0322775 | A1 * | 11/2015 | Marland | E21B 47/06 702/12 |

* cited by examiner

PIT PUMP FOR USE IN A DRILLING FLUID RECYCLING SYSTEM

FIELD

This technical disclosure relates to a pit pump that can be used to pump drilling fluid in a drilling fluid recycling system for recycling of the drilling fluid. The recycled drilling fluid can then be re-used during a drilling operation performed by a drilling system. The drilling fluid can be used in a drilling operation performed by a horizontal directional drill (HDD) or in other drilling systems that use drilling fluid during drilling.

BACKGROUND

Drilling fluid (often called drilling mud) is used by various drilling systems to aid in the drilling of boreholes into the earth. One example of a drilling system that uses drilling fluid is a HDD. In a HDD, used drilling fluid is pumped by a pit pump in a recycling system which recycles the drilling fluid for re-use. The pit pump can be disposed in either the exit pit or the entry pit (or there can be a pump in each pit) where the used drilling fluid collects. During operation the pit pump is typically submerged within the drilling fluid.

During a drilling process, a conventional pit pump often needs to be lifted from the pit for servicing of the pit pump. For example, the drilling fluid typically cakes on the exterior of the pump creating an insulating shell that can prevent dissipation of heat from the pump motor. In addition, the inlet of the pit pump can often become blocked by rocks and other particulate material that is carried by the drilling fluid from the borehole. However, servicing of the pit pump is time consuming and results in down time of the drilling operation.

SUMMARY

A pit pump is described herein that is configured to permit the pit pump to remain disposed within the pit and submerged in the drilling fluid for long periods of time, thereby reducing or eliminating the need to remove the pit pump from the pit for servicing. The pit pump can be used in any drilling fluid recycling system. A drilling fluid recycling system can be used with many types of drilling systems that use drilling fluid while drilling boreholes in the earth. For example, the drilling fluid recycling system can be used with a HDD.

In one embodiment, the pit pump is driven by a liquid cooled electric drive motor. In this embodiment, a liquid is in direct contact with the electric drive motor to cool the electric drive motor, and the cooling liquid is circulated to an external heat exchanger located outside of the pit to cool the cooling liquid before being returned back to the electric drive motor. The pit pump can stay submerged in the drilling fluid within the pit indefinitely since the pit pump does not require removal of caked-on drilling fluid to prevent overheating of the electric drive motor since the cooling liquid cools the electric drive motor. Further, the liquid cools the electric drive motor even if the pump is stalled.

The electric drive motor can be any electric drive motor that is liquid cooled. In one embodiment, the electric drive motor can be a bi-directional permanent magnet motor. Because the motor is bi-directional, the rotation direction of the pump impeller can be reversed. Reversal of the rotation direction can be useful to help clear away material that may be blocking or impeding flow through the pump inlet. In particular, the discharge hose of the pump normally holds a certain amount of head volume and pressure while pumping. If the pump impeller is reversed, the head volume and pressure is released back out of the inlet of the pump thereby dislodging any material that may be lodged in the inlet.

In another embodiment, the pit pump can be configured to permit remote, electronic monitoring of the pit pump. For example, one or more of the motor temperature, temperature of the cooling liquid, motor torque, revolutions per minute of the electric motor and/or of the impeller, horsepower, and vibrations of the electric motor and/or of the pump impeller, and other variables can be monitored. Non-pump variables such as the weight of the drilling fluid, viscosity, head pressure, and the length of the hose connected to the outlet of the pit pump can also be measured. The operation of the pit pump can also be remotely controlled, either wirelessly or via a physical connection via a tether or a wire. The pit pump can include a controller thereon that receives readings from one or more sensors.

In one embodiment, readings concerning the motor torque, the revolutions per minute of the electric drive motor, the horsepower being provided by the electric drive motor, the drilling fluid weight and the hose length can be used together to determine or calculate the volume of the drilling fluid being pumped. This permits the operator to calculate the volume without using a mechanical flow meter or ultrasonic sensor. In some embodiments, one or more sensors can be provided, for example at or near the outlet of the pump, to sense an actual volume being output which can then be used to validate the determined/calculated volume. In addition, the weight of the drilling fluid in the pump output can be calculated based on the torque on the electric drive motor.

DRAWINGS

DETAILED DESCRIPTION

Figure 1:
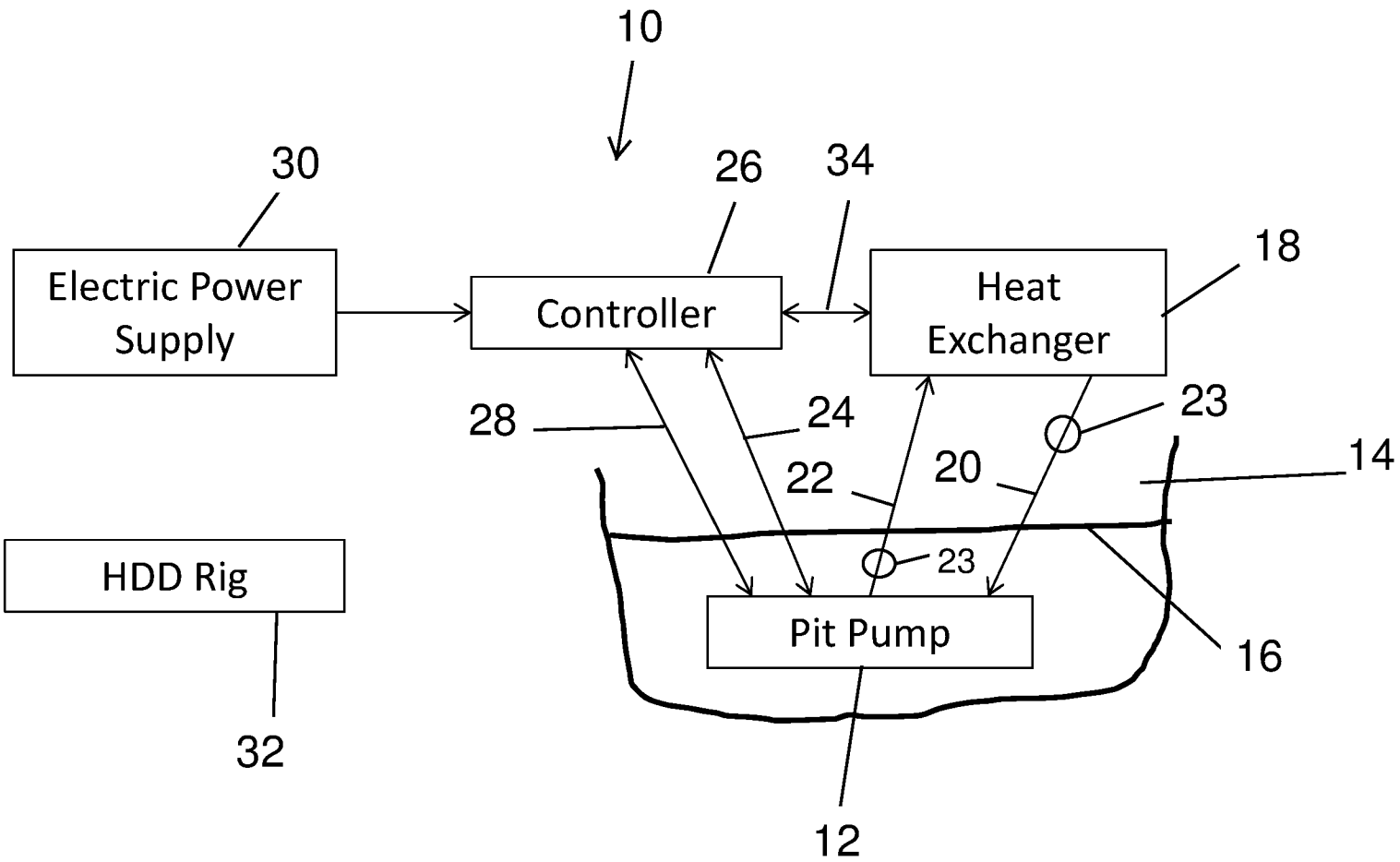
FIG. 1 is a schematic depiction of a drilling system that can use the pit pump described herein.

Referring to FIG. 1, a drilling system 10 is illustrated in which a pit pump 12, forming part of a drilling fluid recycling system, described herein can be used. The drilling system 10 can be any type of drilling system that drills boreholes in the earth and in which a drilling fluid (or drilling mud) is used to aid in the drilling process. For sake of convenience in facilitating this description, the drilling system 10 will be described as being a horizontal directional drilling (HDD) system. However, the drilling system 10 could be a vertical drilling system or other type of drilling system.

The pit pump 12 is part of a drilling fluid recycling system that is used to recycle used drilling fluid for re-use during a borehole drilling operation. Used drilling fluid from the drilling operation, mixed together with solids from the borehole, can collect in a pit 14, which can be an exit pit or an entry pit, with the used drilling fluid mixed with solids then being pumped by the pit pump 12 to a drilling fluid recycler where the used drilling fluid is processed to remove the solids and to make the drilling fluid otherwise suitable for reintroduction back into the borehole. The construction and operation of a drilling fluid recycling system is well known in the art. The pit 14 is illustrated as having used drilling fluid 16 therein, and the pit pump 12 is disposed in the pit 14 so that the pit pump 12 is at least partially submerged in the used drilling fluid 16. Typically, the pit pump 12 will be completely submerged in the used drilling fluid 16 as is illustrated in FIG. 1.

As will be discussed in further detail below, the pit pump 12 can be driven by an electric drive motor, and a cooling liquid is used to cool the electric drive motor. The cooling liquid is circulated between the pit pump 12 and an external heat exchanger 18 by a cooling liquid supply pipe (or hose) 20 and a cooling liquid return pipe (or hose) 22. One or more pumps 23 can be provided for circulating the cooling liquid in the closed coolant loop. For example, the pump 23 can be provided in the supply pipe (or hose) 20 within or outside the drilling fluid 16, in the return pipe (or hose) 22 within or outside the drilling fluid 16, in the heat exchanger 18 or in the pit pump 12 itself. The heat exchanger 18 is located outside the pit 14, and is configured to cool the cooling liquid before the cooling liquid is returned back to the pit pump 12 to cool the electric drive motor. The heat exchanger 18 can be configured as, for example, a liquid-to-air heat exchanger or a liquid-to-liquid heat exchanger.

In addition, electrical energy for powering the electric drive motor of the pit pump 12 can be provided via a power line 24 from a controller 26 that is configured to control operation of the pit pump 12 and the heat exchanger 18. In addition, various data signals can be transmitted over a data line 28 between the pit pump 12 and the controller 26. Electrical energy for powering operation of the various mechanisms described herein can be supplied from a suitable electric power supply 30. Data and power lines 34 can also be provided between the controller 26 and the heat exchanger 18 to direct electrical power to the heat exchanger 18, to control operation of the heat exchanger 18, and to send data signals from the heat exchanger 18 to the controller 26.

The electric power supply 30 can be any supply that is suitable for providing electrical power to the pit pump 12. In one embodiment, the power supply 30 can be an electrical generator. In another embodiment, the power supply 30 can be line power obtained from an available electrical power line. In addition, two power supply sources can be provided with one power supply acting as a back-up in case of failure of the first or primary power supply.

The system 10 can further include a HDD rig 32 that is separate from the drilling fluid recycling system. The HDD rig 32 can have any configuration that is suitable for performing horizontal directional drilling.

Figure 2:
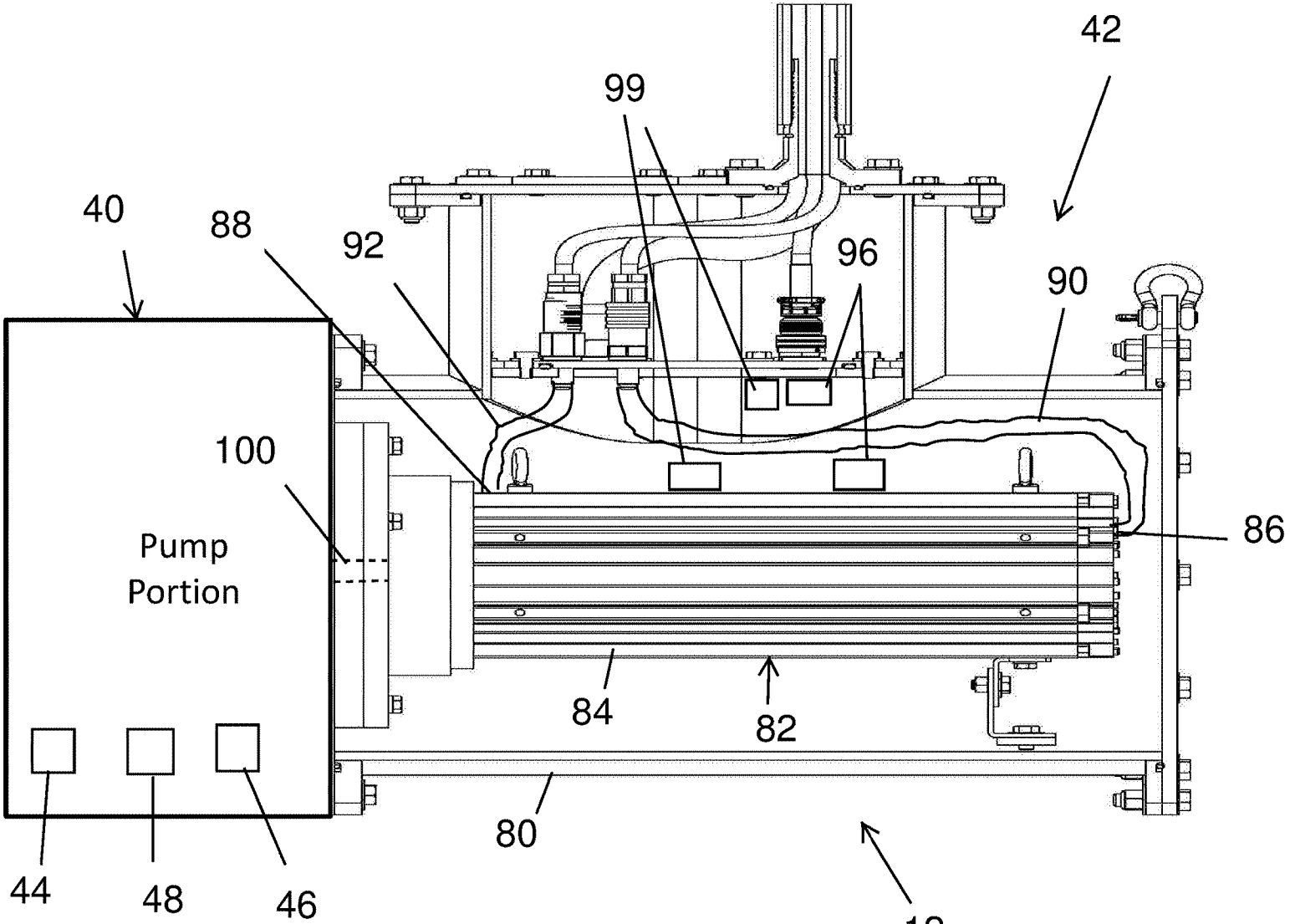
FIG. 2 is a longitudinal cross-sectional view of the pit pump.

One embodiment of the pit pump 12 is illustrated in FIG. 2. In this embodiment, the pit pump 12 includes a pump portion 40 and a drive motor portion 42 that is suitably coupled to the pump portion 40 to drive the pump portion to perform a pumping operation on the used drilling fluid 16. The portions 40, 42 are detachably interconnected to one another to permit removal of any one of the portions 40, 42 and replacement with a different portion 40, 42 or the same portion 40, 42, for example after being serviced.

The pump portion 40 can have any configuration that is suitable for pumping the used drilling fluid 16 mixed with solids. The pump portion 40 will have an inlet, generically designated as 44, through which the used drilling fluid enters the pump portion 40 and an outlet, generically designated as 46, through which the used drilling fluid exits the pump portion 40. The pump portion 40 also includes a pump impeller 48 or other motive device for pumping the used drilling fluid from the inlet 44 to the outlet 46. One example of a suitable pump configuration includes, but is not limited to, a centrifugal pump with the inlet 44 being an axial inlet, the outlet 46 being a radial or tangential outlet, and the pump impeller 48 being rotatably mounted in the pump portion 40. However, other pump configurations can be used.

Figure 3:
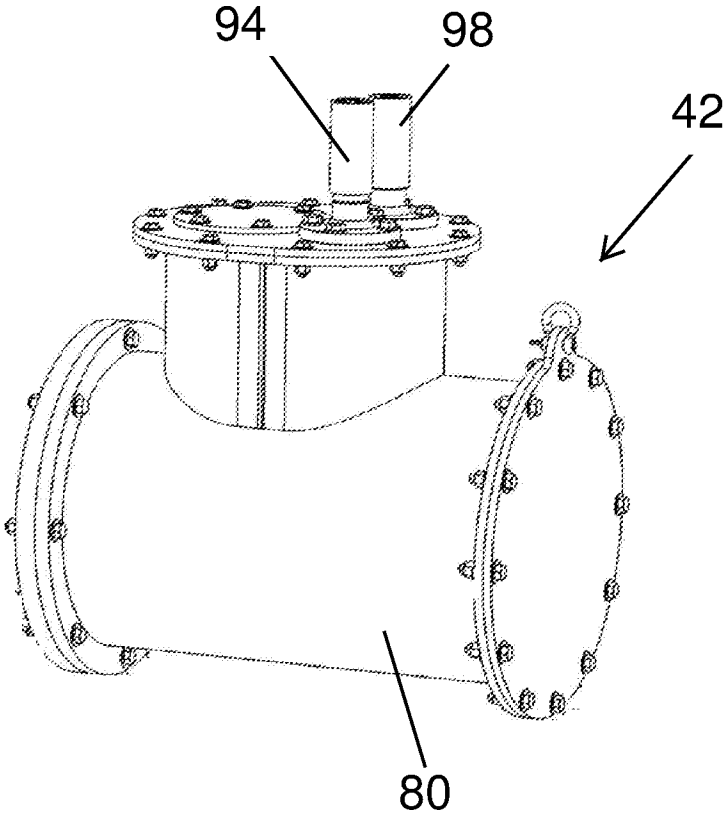
FIG. 3 is a perspective view of the drive motor portion of the pit pump.

With continued reference to FIG. 2 along with FIG. 3, the drive motor portion 42 comprises an optional housing 80 that defines an interior space in which an electric drive motor 82 is disposed for driving the pump impeller 48. The electric drive motor 82 is powered by electricity provided from the electric power supply 30 and the controller 26. The electric drive motor 82 is also reversible in rotation direction in order to be able to reverse the rotation direction of the pump impeller 48. Reversing the direction of rotation of the pump impeller 48 can help to clear away material that may be blocking or impeding flow through the pump inlet 44 or through the impeller 48. In particular, during pumping the outlet 46 of the pump portion 40 holds a certain amount of head volume and pressure from the drilling fluid and perhaps other material entrained in the drilling fluid. If the pump impeller 48 is reversed, the head volume and pressure is released back out the inlet 44 of the pump portion 40 thereby dislodging any material that may be lodged in the inlet 44 or in the impeller 48. The housing 80 is optional and in some embodiments, the electric drive motor 82 can be submerged directly in the drilling fluid within the pit.

The electric drive motor 82 can be any drive motor that can be reversed in rotation direction. In one embodiment, the electric drive motor 82 can include a bi-directional permanent magnet drive motor which permits reversal of the rotation direction. However, other electric drive motors are possible. In addition, as discussed in further detail below, the electric drive motor 82 is configured to be cooled by a suitable cooling liquid, such as, but not limited to, a 50/50 water/ethylene glycol mix, that is circulated through the electric drive motor 82. Liquid-cooled electric drive motors are known in the art.

Referring to FIG. 2, the electric drive motor 82 includes a motor housing 84 that houses the motor components. The housing 84 includes a cooling liquid inlet 86 through which the cooling liquid can be input for cooling the motor components, and a cooling liquid outlet 88 through which the cooling liquid can be output after cooling the motor components. A coolant hose 90 is within the interior space of the housing 80 and is connected between the inlet 86 and the supply pipe (or hose) 20 (FIG. 1) to direct cooling liquid from the heat exchanger 18 after being cooled into the motor housing 84. Similarly, a coolant hose 92 is within the interior space of the housing 80 and is connected between the outlet 88 and the return pipe (or hose) 22 (FIG. 1) to direct cooling liquid back to the heat exchanger 18 to be cooled after absorbing heat in the drive motor 82. The cooling liquid cools the drive motor 82 during normal operations of the drive motor as well as during abnormal operations of the drive motor 82, for example if the pump is stalled.

In one embodiment best seen in FIG. 3, the supply pipe/hose 20 and the return pipe/hose 22 can be disposed within a common umbilical 94 extending from the housing 80 which protects the pipes/hoses 20, 22 from damage. However, the supply pipe/hose 20 and the return pipe/hose 22 do not need to be disposed in the umbilical 94. The data line 28 may also be disposed within the umbilical 94. In addition, electrical energy for powering the drive motor 82 is routed to the drive motor portion 42 via a power umbilical 98 extending from the housing 80 and in which the power line 24 is disposed to protect the power line 24 from damage. In another embodiment, all of the data lines and the power lines can be disposed in a single umbilical.

The drive motor 82 includes a drive shaft 100 (shown in dashed lines in FIG. 2) that is suitably coupled to the pump impeller 48 using coupling techniques known in the art.

Referring to FIGS. 1 and 3, the operation or performance of various components of the pit pump 12 can be electronically monitored and/or operation of the drive motor 82 can be controlled. Data from various sensors and/or for controlling operation of the drive motor 82 can be transmitted between the controller 26 and the pit pump 12 via the data line(s) 28 within the umbilical 94 (and/or within the umbilical 98). Data can also be transmitted between the heat exchanger 18 and the controller 26.

For example, one or more of the following parameters can be monitored by suitable sensors: temperature of the drive motor 82, temperature of the cooling liquid used to cool the drive motor 82, torque of the drive motor 82, revolutions per minute of the drive motor 82 and/or of the impeller 48 (and/or the shaft 100), horsepower, and vibrations of the drive motor 82 and/or of the pump impeller 48. Non-pump variables such as the weight of the used drilling fluid 16, viscosity, head pressure, and the length of the hose connected to the outlet 46 of the pump portion 40 can also be measured. Moisture in the housing 80 (if present) may also be monitored using one or more sensors. The types of sensors necessary to monitor these parameters are well known in the art. Data from the sensors is routed to the controller 26 (and/or routed to an internal controller of the pump described further below) which can monitor the parameters to determine the health of the individual components and how the pit pump 12 is operating. This permits the performance parameters of various elements of the pit pump 12 to be monitored, and if the monitoring determines that an element is not operating correctly, maintenance can be scheduled to replace or repair the element and/or the sensors. Additional sensors can also be added as needed in order to monitor other parameters.

With reference to FIG. 2, in another embodiment, a controller 96 can be incorporated onto the pump 12, for example located on or within the housing 80 or located on the drive motor 82 itself. Signals from the various sensors monitoring the pump 12 can be routed to the controller 96 which in turn can direct signals outside the pump 12 as well as receive signals, such as control signals for controlling operation of the pump 12, from outside the pump 12.

In still another embodiment, a power converter 99, such as a DC to AC inverter that converts DC power to AC power or an AC to DC inverter that converts AC power to DC power, can be incorporated onto the pump 12. For example, the power converter 99 can be located on or within the housing 80 or located on the drive motor 82 itself. If present, the power converter 99 can be connected to the power line 24 to convert incoming electrical power into the appropriate form for use by the pump 12.

Figure 4:
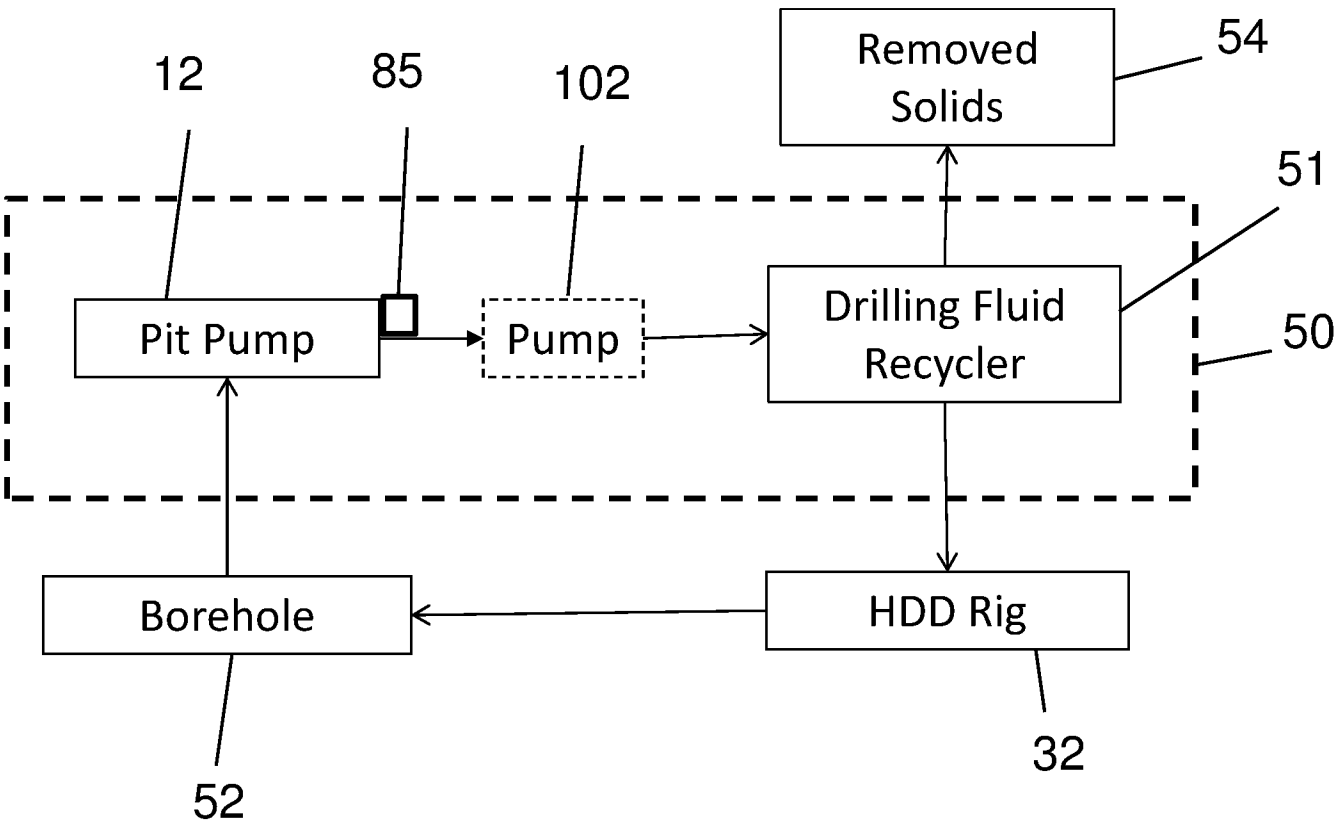
FIG. 4 is a schematic depiction of the drilling system together with a drilling fluid recycling system.

FIG. 4 illustrates an example of the drilling system that includes a drilling fluid recycling system 50 with the pit pump 12 in use with HDD rig 32. The drilling fluid recycling system 50 is a separate system from the HDD rig 32 or other drilling system, and is used to recycle the drilling fluid that is used during drilling operations of the HDD rig 32, and after cleaning the drilling fluid the cleaned drilling fluid is passed through the HDD rig 32 for reintroduction back into the borehole. The drilling fluid recycling system 50 typically does not control any operations of the HDD rig 32, and the HDD rig 32 typically does not control any operations of the recycling system 50. The recycling system 50 includes a drilling fluid recycler 51 that receives drilling fluid to be recycled from the pump 12. In an example drilling operation, the HDD rig 32 drills a borehole 52 aided by the drilling fluid 16 which is pumped down the borehole 52 by the recycling system 50. The used drilling fluid 16 together with solids resulting from the drilling operation are ultimately returned to the pit 14 where the pit pump 12 is disposed. The pit pump 12 pumps the used drilling fluid mixed with solids to the drilling fluid recycler 51. In some embodiments, an optional pump 102 (shown in dashed lines) can be disposed between the pump 12 and the recycler 51, for example in-line, to aid in pumping the used drilling fluid to the recycler 51 for recycling. The recycler 51 removes the solids in a known manner, with the removed solids 54 being collected. The cleaned drilling fluid is then pumped through the HDD rig 32 on its way back into the borehole 52. While the pit pump 12 is operating, the cooling liquid is circulated from the heat exchanger 18 located outside the pit 14, through the cooling liquid inlet 86, through the motor housing 84 and out through the cooling liquid outlet 86 and back to the heat exchanger 18 to cool the cooling liquid before being returned back to the motor housing 84 to continue the cooling cycle.

In one embodiment, the volume of the used drilling fluid mixed with solids pumped by the pit pump 12 and the volume of the cleaned drilling fluid pumped back into the borehole 52 can be determined. The difference between these two volumes provides a determination as to the amount of solids being removed from the borehole 52. A significant difference in the volumes of the used and cleaned drilling fluids can provide an indication of possible leakage of the drilling fluid, for example within the borehole 52, in the pit 14, or elsewhere in the path of the drilling fluid. In addition, the amount of solids being removed provides an indication of the drilling operation and whether the borehole 52 is clean enough.

The volume of the used drilling fluid mixed with solids pumped by the pit pump 12 and the volume of the cleaned drilling fluid pumped into the borehole 52 can be determined using any suitable techniques. For example, mechanical flow meters can be provided at suitable locations at or near the output of the pit pump 12 and at or near the output of the downhole pump. In another embodiment, one or more of the volumes can be determined mathematically using variables and parameters measured from various components of the system. In an embodiment, one or more sensors 85 (seen in FIG. 4) can be provided at or near the outlet of the pump 12. The sensor(s) 85 is used to detect a volume of the fluid being pumped by the pump 12. The volume of fluid detected by the sensor 85 can then be used to compare against a calculated volume pumped by the pump 12 to validate the calculated volume amount. In addition, the torque on the electric drive motor 82 can be detected and used to calculate an estimated weight of the drilling fluid in the output of the pump 12.

Additional embodiments that can be implemented include:

Embodiment 1

A horizontal directional drilling system including:

a horizontal directional drilling rig;

a pit pump disposed within a pit containing drilling fluid for use with drilling operations performed by the horizontal directional drilling rig, the pit pump includes:

a pump portion with an inlet, an outlet, and a pump impeller; and an electric motor in driving engagement with the pump impeller to drive the pump impeller;

the electric motor includes an electric motor housing, a cooling liquid inlet in the electric motor housing through which a cooling liquid can be input for cooling the electric motor, and a cooling liquid outlet in the electric motor housing through which cooling liquid can be output after cooling the electric motor.

Embodiment 2

A pit pump to be used within a pit containing drilling fluid for use with drilling operations performed by a horizontal directional drilling rig, the pit pump including:

a pump portion with an inlet, an outlet, and a pump impeller disposed in the pump housing for pumping drilling fluid from the inlet to the outlet;

an electric motor in driving engagement with the pump impeller to drive the pump impeller, the electric motor includes an electric motor housing;

a cooling liquid inlet in the electric motor housing through which a cooling liquid can be input for cooling the electric motor; and a cooling liquid outlet in the electric motor housing through which cooling liquid can be output after cooling the electric motor.

Embodiment 3

A drilling fluid reclamation method that includes:

disposing a pit pump within a pit intended to contain used drilling fluid after use in a drilling operation performed by a horizontal directional drilling rig, the pit pump includes a pump portion with an inlet, an outlet, and a pump impeller for pumping drilling fluid from the inlet to the outlet, and an electric motor in driving engagement with the pump impeller to drive the pump impeller; the electric motor includes an electric motor housing; a cooling liquid inlet in the electric motor housing through which a cooling liquid can be input for cooling the electric motor; and a cooling liquid outlet in the electric motor housing through which cooling liquid can be output after cooling the electric motor;

operating the pit pump to pump drilling fluid through the pump outlet; and while the pit pump is operating, circulating cooling liquid from a heat exchanger located outside the pit, through the cooling liquid inlet, through the electric motor housing, through the cooling liquid outlet and back to the heat exchanger in order to cool the electric motor using the cooling liquid.

Embodiment 4

A pit pump operation method comprising:

rotating a pump impeller of the pit pump in a first direction in order to pump drilling fluid in through an inlet of the pit pump and out through an outlet of the pit pump, thereby generating a head volume and pressure in the outlet; and thereafter reversing the rotation of the pump impeller in order to rotate the pump impeller in a second direction, whereby the head volume and the pressure is released back out the inlet of the pump thereby dislodging any material that may be lodged in the inlet.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A pit pump system comprising:

a pit containing used drilling fluid therein;

a pit pump that includes a pump portion and a drive motor portion, the pit pump is disposed within the pit with the pump portion and the drive motor portion at least partially submerged in the used drilling fluid;

the pump portion includes an inlet, an outlet, and a pump impeller for pumping the used drilling fluid from the inlet to the outlet;

the drive motor portion includes an electric drive motor in driving engagement with the pump impeller to drive the pump impeller, the electric drive motor includes a motor housing;

a cooling liquid inlet in the motor housing through which a cooling liquid can be input for cooling the electric drive motor;

a cooling liquid outlet in the motor housing through which cooling liquid can be output after cooling the electric drive motor; and a heat exchanger located outside the pit, the cooling liquid inlet and the cooling liquid outlet are fluidly connected to the heat exchanger.

2. The pit pump system of claim 1, wherein the electric drive motor is reversible whereby a rotation direction of the impeller can be reversed and a flow of the used drilling fluid through the pump portion can be reversed.

3. The pit pump system of claim 1, further comprising a controller and/or a power converter on the pit pump.

4. The pit pump system of claim 3, wherein the electric drive motor is disposed within a housing, and the controller and/or power converter are disposed within the housing.

5. The pit pump system of claim 3, wherein the power converter converts DC power to AC power or converts AC power to DC power.

6. The pit pump system of claim 1, further comprising a controller on the pit pump, and further comprising at least one sensor electrically connected to the controller.

7. The pit pump system of claim 6, wherein the controller is configured to calculate a volume of the used drilling fluid being pumped by the pump portion using data from the at least one sensor, and further comprising at least one additional sensor at or near the outlet and electrically connected to the controller for sensing a volume of the used drilling fluid that is being pumped, and the controller compares the calculated volume with the sensed volume.

8. A drilling fluid recycling system using the pit pump system of claim 1.

9. A pit pump system comprising:

a pit containing used drilling fluid therein;

a pit pump that includes a pump portion and a drive motor portion, the pit pump is disposed within the pit with the pump portion and the drive motor portion at least partially submerged in the used drilling fluid;

the pump portion includes an inlet, an outlet, and a pump impeller for pumping the used drilling fluid from the inlet to the outlet;

the drive motor portion includes an electric drive motor in driving engagement with the pump impeller to drive the pump impeller, the electric drive motor includes a motor housing;

a liquid cooling system fluidly connected to the electric drive motor for cooling the electric drive motor using a liquid, the liquid cooling system includes a heat exchanger located outside the pit and fluidly connected to the pit pump;

a controller on the pit pump that controls operation of the electric drive motor; and at least one sensor electrically connected to the controller.

10. The pit pump system of claim 9, further comprising a housing in which the electric drive motor is disposed; and the controller is disposed within the housing.

11. The pit pump system of claim 9, wherein the electric drive motor is reversible whereby a rotation direction of the impeller can be reversed and a flow of the used drilling fluid through the pump portion can be reversed.

12. The pit pump system of claim 9, further comprising a power converter on the pit pump.

13. The pit pump system of claim 12, wherein the power converter converts DC power to AC power or converts AC power to DC power.

14. The pit pump system of claim 9, wherein the controller is configured to calculate a volume of the used drilling fluid being pumped by the pump portion using data from the at least one sensor, and further comprising at least one additional sensor at or near the outlet and electrically connected to the controller for sensing a volume of the used drilling fluid that is being pumped, and the controller compares the calculated volume with the sensed volume.

15. A drilling fluid recycling system using the pit pump system of claim 9.

16. A pit pump to be used within a pit containing drilling fluid for use with drilling operations, the pit pump comprising:

a pump portion with an inlet, an outlet, and a pump impeller for pumping drilling fluid from the inlet to the outlet;

an electric drive motor in driving engagement with the pump impeller to drive the pump impeller, the electric drive motor includes a motor housing;

a controller on the pit pump that controls operation of the electric drive motor;

at least one sensor electrically connected to the controller; and a sensor that senses torque on the electric drive motor, and the controller determines the weight of drilling fluid in the output based on the sensed torque.

17. A drilling fluid recycling system, comprising:

a pit having used drilling fluid therein;

a pit pump that includes a pump portion and a drive motor portion, the pit pump is disposed within the pit with the pump portion and the drive motor portion at least partially submerged in the used drilling fluid;

the pump portion includes an inlet, an outlet, and a pump impeller for pumping the used drilling fluid from the inlet to the outlet;

the drive motor portion includes an electric drive motor in driving engagement with the pump impeller to drive the pump impeller, the electric drive motor includes a motor housing; a cooling liquid inlet in the motor housing through which a cooling liquid can be input for cooling the electric drive motor; and a cooling liquid outlet in the motor housing through which cooling liquid can be output after cooling the electric drive motor;

a cooling liquid supply hose fluidly connected to the cooling liquid inlet to direct the cooling liquid into the motor housing and a cooling liquid return hose fluidly connected to the cooling liquid outlet to direct the cooling liquid from the motor housing; and a heat exchanger located outside the pit, the cooling liquid supply hose and the cooling liquid return hose are fluidly connected to the heat exchanger.

18. The drilling fluid recycling system of claim 17, wherein the electric drive motor is reversible whereby a rotation direction of the impeller can be reversed and a flow of the used drilling fluid through the pump portion can be reversed.

19. The drilling fluid recycling system claim 17, wherein the electric drive motor is disposed within a housing, and further comprising a controller and a power converter disposed within the housing.

20. The drilling fluid recycling system claim 17, wherein the pump portion and the drive motor portion are completely submerged in the used drilling fluid.

21. A drilling fluid recycling system, comprising:

a pit having used drilling fluid therein;

a pit pump that includes a pump portion and a drive motor portion, the pit pump is disposed within the pit with the pump portion and the drive motor portion at least partially submerged in the used drilling fluid;

the pump portion includes an inlet, an outlet, and a pump impeller for pumping the used drilling fluid from the inlet to the outlet;

the drive motor portion includes an electric drive motor in driving engagement with the pump impeller to drive the pump impeller, the electric drive motor includes a motor housing; a cooling liquid inlet in the motor housing through which a cooling liquid can be input for cooling the electric drive motor; and a cooling liquid outlet in the motor housing through which cooling liquid can be output after cooling the electric drive motor;

a housing defining an interior space, the entirety of the drive motor portion is located within the interior space of the housing;

a first coolant hose in the interior space and connected between the cooling liquid inlet and a supply hose located outside the housing; and a second coolant hose in the interior space and connected between the cooling liquid outlet and a return hose located outside the housing.

22. The drilling fluid recycling system of claim 21, wherein the electric drive motor is reversible whereby a rotation direction of the impeller can be reversed and a flow of the used drilling fluid through the pump portion can be reversed.

23. The drilling fluid recycling system claim 21, wherein the electric drive motor is disposed within a housing, and further comprising a controller and a power converter disposed within the housing.

24. The drilling fluid recycling system claim 21, wherein the pump portion and the drive motor portion are completely submerged in the used drilling fluid.

25. A drilling system, comprising:

a drilling rig;

a pit having used drilling fluid therein;

a pit pump disposed within the pit, the pit pump includes a pump portion and a drive motor portion, and the pump portion and the drive motor portion are at least partially submerged in the used drilling fluid;

the pump portion includes an inlet, an outlet, and a pump impeller for pumping the used drilling fluid from the inlet to the outlet;

the drive motor portion includes an electric drive motor in driving engagement with the pump impeller to drive the pump impeller, the electric drive motor includes a motor housing; a cooling liquid inlet in the motor housing through which a cooling liquid can be input for cooling the electric drive motor; and a cooling liquid outlet in the motor housing through which cooling liquid can be output after cooling the electric drive motor;

a cooling liquid supply hose fluidly connected to the cooling liquid inlet to direct the cooling liquid into the motor housing and a cooling liquid return hose fluidly connected to the cooling liquid outlet to direct the cooling liquid from the motor housing; and a heat exchanger located outside the pit, the cooling liquid supply hose and the cooling liquid return hose are fluidly connected to the heat exchanger.

* * * * *